US005407112A

United States Patent [19]

Christodoulou et al.

[11] Patent Number: 5,407,112

[45] Date of Patent: Apr. 18, 1995

[54] CONVERTIBLE BACKPACK

[76] Inventors: Thomas N. Christodoulou, 12807 Black Oak Dr., Laurel, Md. 20708; Gwendolyn O. Daniels, 2210 N. 3rd St. #6, Harrisburg, Pa. 17110

[21] Appl. No.: 78,900

[22] Filed: Jun. 21, 1993

[51] Int. Cl.[6] ..... A45F 4/02

[52] U.S. Cl. ..... 224/153; 2/94; 224/209; 224/260

[58] Field of Search ..... 2/94; 224/153, 202, 224/209, 210, 261, 260

[56] References Cited

U.S. PATENT DOCUMENTS

| | | | |
|---|---|---|---|
| D. 323,237 | 1/1992 | Zolhe | D2/185 |
| 2,165,348 | 7/1939 | Daiber . | |
| 3,989,080 | 11/1976 | Koszegi | 190/44 X |
| 4,389,735 | 6/1983 | McLaughlin | 2/94 |
| 4,563,777 | 1/1986 | Park | 2/94 X |
| 4,792,040 | 12/1988 | Wagstaff, III | 224/151 X |
| 4,932,574 | 6/1990 | Doshi | 224/153 |
| 5,123,117 | 6/1992 | Prendergast | 2/94 X |
| 5,165,111 | 11/1992 | Lieberman | 2/94 |

FOREIGN PATENT DOCUMENTS

| | | | |
|---|---|---|---|
| 2345957 | 4/1976 | France | 2/94 |
| 2948713 | 6/1981 | Germany | 224/153 |
| 59771 | 4/1912 | Switzerland | 224/153 |
| 1561459 | 2/1980 | United Kingdom | 2/94 |

*Primary Examiner*—Ernest G. Cusick
*Attorney, Agent, or Firm*—Robert Halper

[57] ABSTRACT

A convertible packpack having a storage compartment for a raincoat in the front of the pack covered by a completely detachable totebag having handles and a plurality of storage compartments in the back of the pack, the raincoat being held fast in the storage compartment by fastening straps that can also be used to support the totebag at the bottom of the pack when the raincoat is worn or alternatively the tote bag can be held at the bottom of the pack in suspended condition.

9 Claims, 3 Drawing Sheets

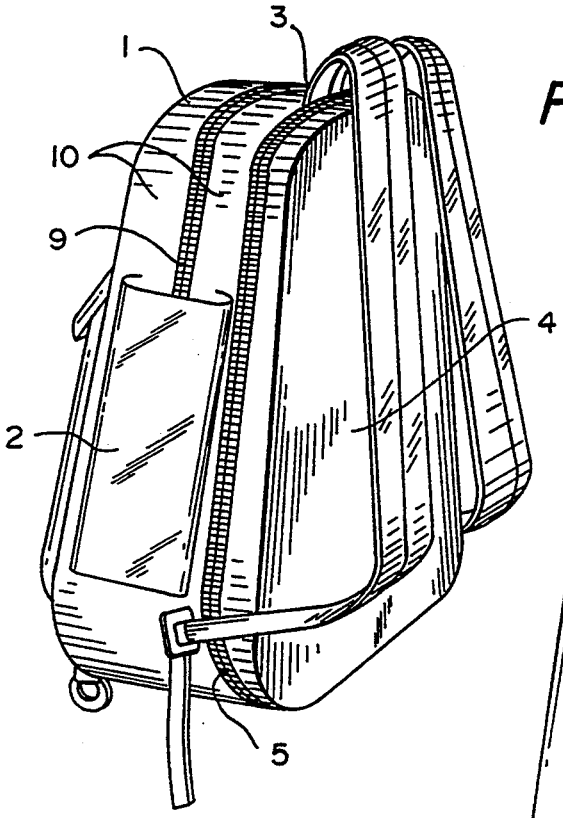
FIG. 1A
FIG. 1B
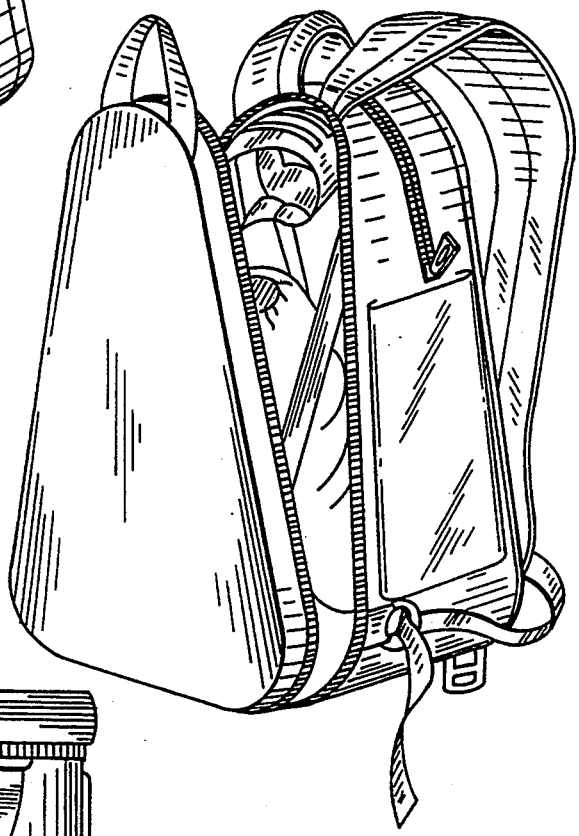
FIG. 1C
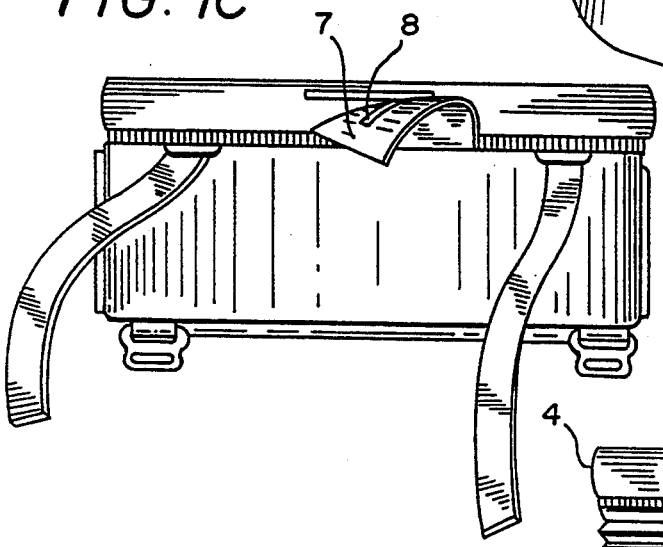
FIG. 1D
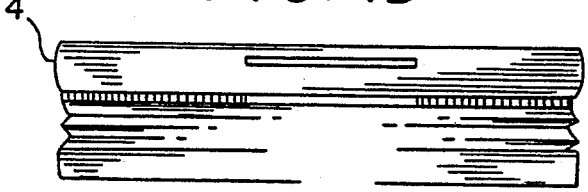

CONVERTIBLE BACKPACK

FIELD OF INVENTION

This invention concerns a convertible backpack. In particular the invention pertains to a backpack which has a storage compartment for a raincoat and the compartment is overlaid by a detachable totebag.

BACKGROUND OF THE INVENTION

There are a number of backpacks in use today. An early example of a combination outdoor jacket and pack is U.S. Pat. No. 2,165,348. The jacket has a zipper and collar. When used as a pack, the jacket is simply turned inside out, exposing straps to carry the enclosed jacket. There is also a back pocket in the back of the jacket which can be used for carrying loads when the jacket is worn. U.S. Pat. No. 3,989,080 shows a carrying case with multiple compartments. When not in use, one of the compartments may be folded over into a stored position and secured by a flap. The flap carries a clip so that the carrying case may be carried on the belt of a user. There is also a shoulder strap. U.S. Pat. No. 4,563,777 shows a combination cargo pack with a plurality of compartments including side pockets. A front panel is secured by a slide fastener. The panel contains a pouch for a garment such as a hooded jacket or parka. There is also a strapped handle for carrying the pack sewed to a top panel as well as shoulder straps for carrying the pack. Within the pouch are tie down straps whose purpose is to tie down the flap closure when the jacket is worn. The straps are used in cooperation with a pair of buckles attached to the bottom panel. U.S. Pat. No. 4,792,040 is an example of a combination pack which has in its rear two storage compartments, one of which is used to store a motorcycle cover and the other is used to store a rain suit. Both the rain suit and cover are attached to a pouch in the pack. A flap closes both compartments and the same is fastened by a "Velcro" fastener. The rain suit also has "Velcro" fasteners at the wrist and neck. Normally the pack is stored behind the back of the motorcycle. When the rain suit is in use the storage pouch is seated on the back of the user. U.S. Pat. No. 4,932,574 is illustrative of a coat which may be folded up when not in use, wherein there are provided various loops for carrying the folded coat on the shoulders, on the arms or on the hand as a suit case. Additionally other garments or articles may be folded up with the coat. U.S. Design Pat. D323,237 shows a design for a combination backpack and convertible parka. There are a number of storage compartments in this design which seem to be fastened with slide fasteners. There is also a strap for carrying the fully closed pack, but the design does not show use of shoulder straps.

As can be seen the devices of some of these patents simply use garments converted into backpacks, or the use of a raincoat stored in a pouch, but when the rain suit is not in use, not intended to be carried on the back. The convertible backpack and pouch of the design patent is not provided with any additional storage compartments and requires the user to carry the load on the lower part of the back without benefit of any shoulder strap support. U.S. Pat. No. 4,563,777 has a number of similarities to the device of this invention; however, in this application there are a number of advantageous differences also. For one this invention stores a raincoat in the pouch rather than a jacket and instead of a flap as a cover, there is a completely detachable totebag.

Accordingly it is an object of this invention to provide a convertible backpack which has improved features as well as additional features over the cargo packs presently available.

Another object of the invention is to provide a combination backpack that has incorporated in the backpack a raincoat.

A further object of the invention is to provide a combination backpack which has a completely detachable totebag overlying the storage compartment for the rain coat.

It is an additional object of this invention is to provide a combination backpack that has a raincoat, integral with the storage compartment and held in place by fastening straps, wherein the backpack is also provided with a number of easily accessible storage compartments.

A still further object of this invention is the provision of supporting the tote bag at the bottom of the pack when not in use.

SUMMARY OF THE INVENTION

The convertible backpack of this invention is versatile and durable. Shoulder straps are attached directly to the backpack in front of a completely detachable totebag which also serves as a cover for a raincoat storage compartment. The raincoat is folded over in the storage compartment and held fast with securing straps which also can be used to support the totebag in rolled condition at the bottom of the pack. The raincoat is stitched to the inside of the storage compartment and when worn is held together by a draw string and a longitudinally extending zippered fastener. A hood is nested in a zippered collar of the raincoat. Beside the main storage compartment in the back of the pack opposite the front raincoat storage compartment there are four other storage compartments, in addition to two lateral pockets.

BRIEF DESCRIPTION OF THE DRAWINGS

FIG. 1A is a left lateral view of backpack showing side pocket and zippered major storage compartment.

FIG. 1B is a front perspective view showing a tote bag partially unzippered.

FIG. 1C is a bottom plan view showing a hook and loop fastener for suspending the tote bag to the back pack along with an attaching zipper and raincoat securing straps.

FIG. 1D is a top plan view showing main storage compartment, attached tote bag and raincoat storage compartment.

DETAILED DESCRIPTION OF THE PREFERRED EMBODIMENT

Figure 2A:
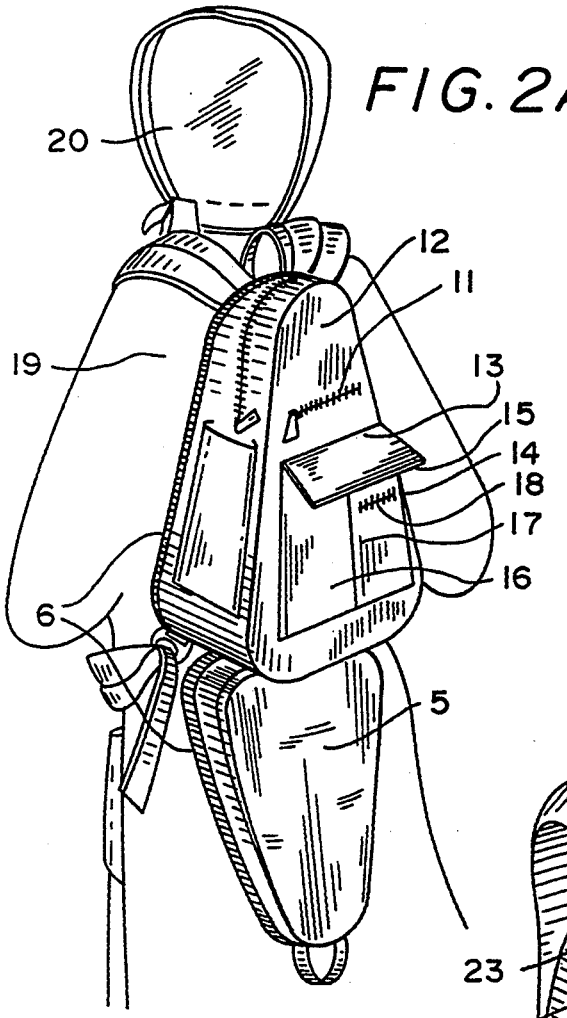
FIG. 2A shows a perspective rear view of the tote bag attached to the back pack in suspended condition and the hooded raincoat .
Figure 2B:
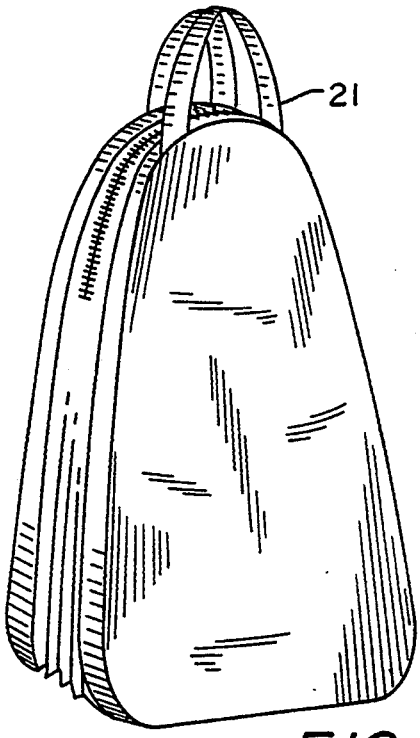
FIG. 2B is a front view of the completely detached tote bag.
Figure 3A:
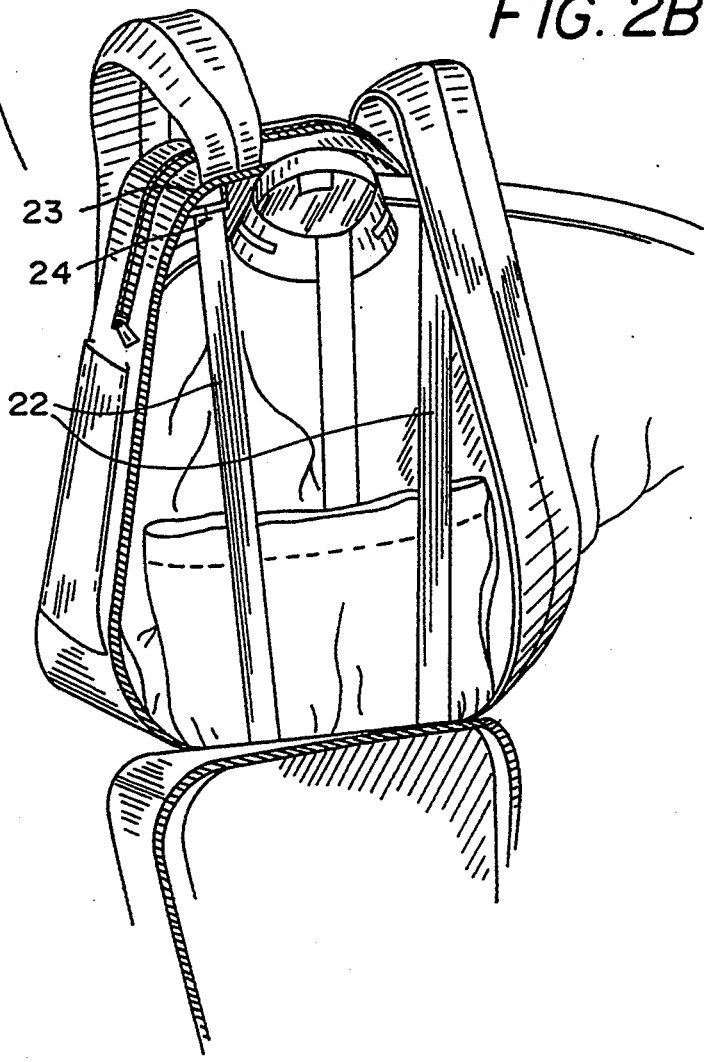
FIG. 3A is a front view showing the rain coat storage compartment with folded raincoat and raincoat securing straps.
Figure 3B:
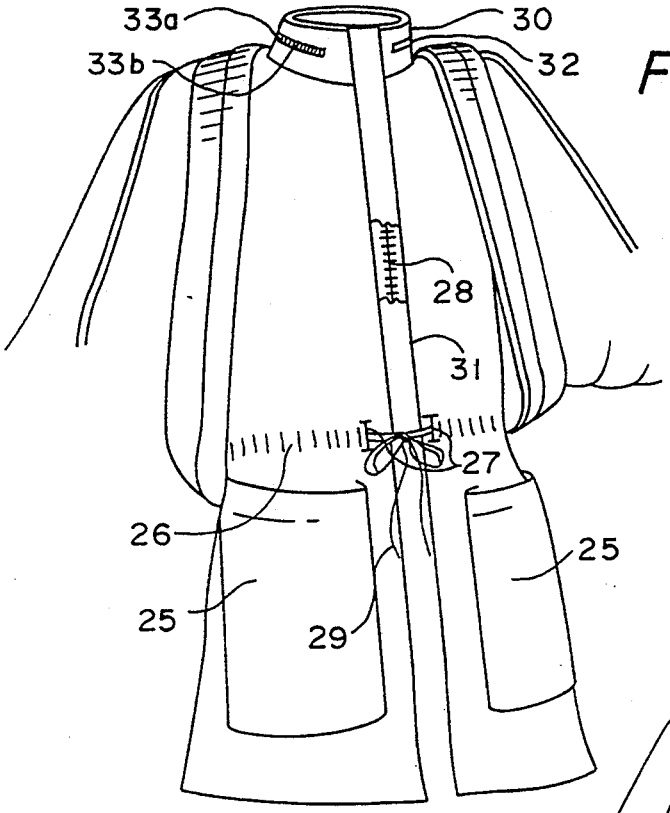
FIG. 3B is a front view showing details of the raincoat and location of the back pack straps when wearing the attached raincoat.
Figure 3C:
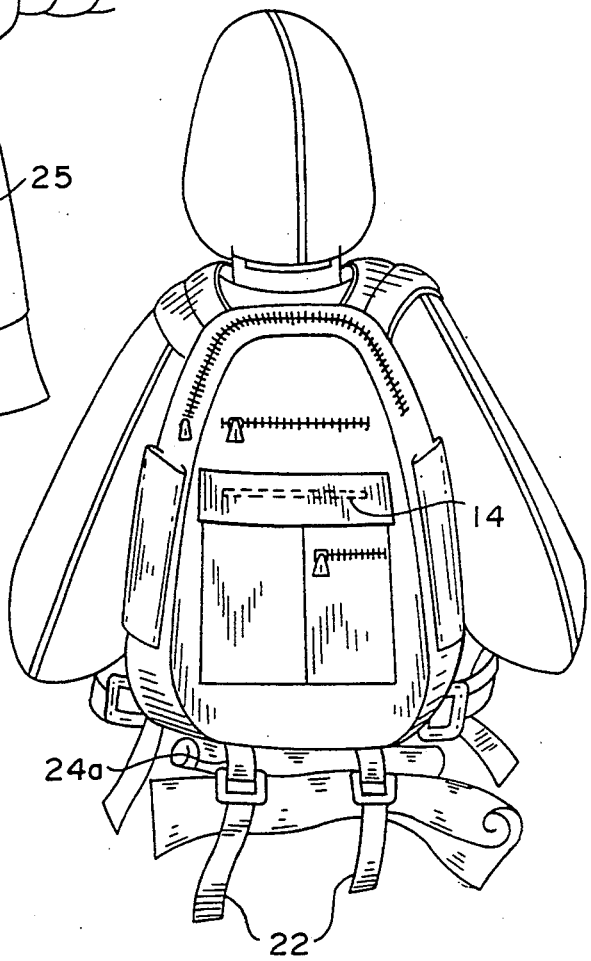
FIG. 3C is a rear view of the back pack illustrating the various storage compartments and the securement of the folded tote bag at the bottom of the pack.

In FIG. 1*a* there is shown the combination backpack assembly 1 with side pocket 2. An identical pocket is also located on the opposite side, Shoulder straps 3 are attached directly to the pack in front of a detachable tote bag 4. The totebag also serves as a top cover for a rain coat storage compartment 5. As best seen in FIG. 2A the backpack has a distinctive shape which is more or less that of a paraboloid and the detachable tote bag is secured to the raincoat storage compartment by a zippered fastener 6 which follows the general shape of the pack and extends around substantially the entire perimeter except for a small segment in the central region, as seen in FIG. 1C, at the bottom of the pack. In this region extending from the rim of the pack is a rectangular tab 7 containing on its inner surface a segment of hook and loop material 8 which mates with a corresponding segment on the tote bag and along with the zippered fastener supports the tote bag when in suspended condition from the bottom of the pack. As best seen in FIG. 1A, the back pack is about seven inches wide and in its midsection with respect to the width is another zippered fastener 9 for the main storage compartment 10, located in the back side as opposed to the front side where the raincoat compartment is located. This fastener extends only partially down the sides and terminates near to and above the side pockets. The main storage compartment extends widthwise from the zippered fastener for the totebag to near the end of the pack and lengthwise occupies the length of the pack. About a quarter distance down from the top of the main storage compartment, as seen in FIG. 2A, is a third slide fastener 11 that extends transversely to a position near the sides of the pack. This slide fastener forms a closure for another compartment 12 which is made by stitching a narrow strip of material shaped to conform to the outlines of the main storage compartment onto the same. Somewhat below fastener 11 is a rectangular flap 13 that extends the width of compartment 12 and forms a cover for a rectangular pocketed compartment 14, which is a sewn extension of compartment 12. Flap 13 is fastened to the compartment by corresponding strips of hook and loop material 15 on the respective interior of the flap and the exterior of the pocketed compartment. Below the lower edge of the cover are two more stitched extensions of the pocketed compartment. These extensions form small dual compartments aligned side by side. Compartment 16 on the left is an open pocket, while compartment 17 on the right is closed by a small transverely extending zipper 18. In this view there is also shown the back of a raincoat 19 worn by a user as well as a hood 20. The shoulder straps carry the backpack and the tote bag is suspended from the bottom of the pack. FIG. 2B shows the tote bag completely detached from the pack and having two handles 21 for carrying the bag. Each handle is spaced from the other by the width of the bag with the handle being sewed into the folds of the top of the bag. FIG. 3C illustrates the tote bag in rolled up condition and supported by two parallel fastening straps 22. FIG. 3A shows that these straps normally hold the raincoat fast in the storage compartment where the straps are secured to a pair of small straps 23 by a strip of hook and loop material 24 located at the respective ends of each set of straps. Straps 23 are suspended from the top of the raincoat storage compartment and sewn thereto. When the tote bag is rolled up, fastening straps 22 extend around the roll and are secured by the same type of hook and loop material described above except that the corresponding hook and loop material is at the ends of straps 24*a* suspended from the bottom of the pack to which the straps are stitched. In FIG. 3B there is seen a front view of the raincoat as worn. The raincoat has two large rectangular pockets 25. Above the pockets and in the center of the raincoat is a circumferentially extending reenforcing strip 26 sewn over the raincoat fabric and having two slots 27 on either side of a longitudinally extending slide fastener 28. In the reenforcing strip is a draw string 29 that passes through the slots and aids in adjusting the fit of the raincoat. The slide fastener extends from a collar 30 at the top to near the bottom of the raincoat. Overlapping the fastener and extending to the top of the collar is a narrow band of fabric 31 that serves as a shield for the fastener. Within the collar is a circular rolled up segment of material 32 which when unrolled and removed from the collar serves as a hood. The collar is slitted and at the borders of the collar created by the slit there are sewn two aligned circular strips of hook and loop material 33*a*, 33*b* wherein strip 33*b* overlaps 33*a*. When the two strips are fastened together, the hood is safely stored within the collar.

Having described the subject matter of this invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A convertible backpack having a front and backside comprising a plurality of storage compartments, one of said plurality of storage compartments being located on said back side and a number of said plurality of storage compartments being located on said back side, said one storage compartment having a top, lateral sides and a bottom, and containing a raincoat within and integral therewith, a completely detachable totebag overlying said one storage compartment and fastened thereto by a slide fastener that extends from said top, down said lateral sides and a substantial portion of said bottom, a pair of shoulder straps attached to said backpack in front of said totebag for supporting said pack, said raincoat being in folded condition in said one storage compartment and held in place by a pair of fastening straps, secured by corresponding strips of hook and loop material, a set of strips located adjacent said top of said one storage compartment and another set of strips located at the ends of said fastening straps, said raincoat having a bottom, top and a collar at said top and when worn being held in place by a longitudinal slide fastener extending from said collar at the top to near the bottom of said raincoat, said raincoat having a narrow band of fabric overlying and shielding said fastener, said collar housing a hood and having a circular slit to provide access to said hood, said collar having edges adjacent said slit and a strip of hook and loop material on each of said edges for closing said slit, a band of reenforcing material extending around the perimeter of said rain coat and containing slots, one on each side of said band, a draw string passing through said reenforced strip and extending through said slots, said draw string enabling adjustment of the fit of said raincoat.

2. A backpack as in claim 1 wherein said fastening straps for holding said raincoat in place comprise a pair of upstanding parallel straps and another pair of parallel straps suspended from the top of said one storage compartment, each of said pairs of straps having hook and loop material for fastening said straps together.

3. A backpack as in claim 1 wherein said backpack is paraboloidal in shape and said tote bag, is suspended from said one storage compartment and means for holding said totebag in suspension at the bottom of said pack.

4. A backpack as in claim 3 wherein said means comprises said slide fastener at the bottom of said pack.

5. A backpack as in claim 4 wherein said slide fastener at said bottom extends only partially at said bottom and said one storage compartment has a tab in the central region of said bottom having a strip of hook and loop material on its inner surface, said hook and loom material mating with a corresponding strip located on the outer surface of the bottom of said totebag, said mating strips assisting in holding said totebag in suspension.

6. A backpack as in claim wherein said totebag is suspended from said one storage compartment and is supported in rolled condition at the bottom of said pack by fastening straps released from holding said raincoat and secured to buckles at the bottom of said pack.

7. A backpack as in claim 1 wherein said totebag has a pair of looped handles and is completely detached (completely) from said pack and has a pair of looped handles for carrying said bag.

8. A backpack as in claim 1 wherein said plurality of storage compartments on said back side include a main storage compartment that extends across from said slide fastener of said one storage compartment to near the width of said pack and runs lengthwise from said top to said bottom, said pack having pockets on said lateral sides and a slide fastener for said main storage compartment extending from the midsection of said top to along the sides just above said pockets.

9. A backpack as in claim 8 wherein there are other storage compartments on said back side, said other storage compartments being extensions of said main storage compartment and formed by stitching a strip of material to said main storage compartment near said width, said strip conforming to the general shape of said pack.

* * * * *